US009080828B2

(12) United States Patent
Chiappini

(10) Patent No.: US 9,080,828 B2
(45) Date of Patent: Jul. 14, 2015

(54) ASSEMBLY OF TURRET AND LOW RADAR REFLECTION WEAPON

(75) Inventor: Andrea Chiappini, La Spezia (IT)

(73) Assignee: OTO Melara S.p.A., La Spezia (SP) (IT)

( * ) Notice: Subject to any disclaimer, the term of this patent is extended or adjusted under 35 U.S.C. 154(b) by 0 days.

(21) Appl. No.: 14/119,777

(22) PCT Filed: May 8, 2012

(86) PCT No.: PCT/IB2012/000908

§ 371 (c)(1), (2), (4) Date: Feb. 19, 2014

(87) PCT Pub. No.: WO2013/050834

PCT Pub. Date: Apr. 11, 2013

(65) Prior Publication Data

US 2014/0150637 A1 Jun. 5, 2014

(30) Foreign Application Priority Data

May 25, 2011 (IT) ..... TO2011A0455

(51) Int. Cl.

| | |
|---|---|
| ***F41A 23/24*** | (2006.01) |
| ***B63G 1/00*** | (2006.01) |
| ***F41A 23/20*** | (2006.01) |
| ***F41H 3/00*** | (2006.01) |
| ***F41H 5/12*** | (2006.01) |

(Continued)

(52) U.S. Cl.

CPC . *F41A 23/24* (2013.01); *B63G 1/00* (2013.01); *F41A 23/20* (2013.01); *F41H 3/00* (2013.01); *F41H 5/12* (2013.01); *F41H 5/16* (2013.01); *F41H 5/20* (2013.01)

(58) Field of Classification Search

CPC ..... F41A 23/24; F41A 23/22; F41A 23/20; F41H 5/20; F41H 5/16; F41H 3/00; F41H 5/12; B63G 1/00

USPC ..... 89/36.13, 36.14, 935, 38, 37.01, 40.03, 89/37.06; 114/316, 320, 175, 5–8

See application file for complete search history.

(56) References Cited

U.S. PATENT DOCUMENTS

| | | | | | |
|---|---|---|---|---|---|
| 36,273 | A | * | 8/1862 | Brown | 89/37.12 |
| 1,093,504 | A | * | 4/1914 | Voller | 89/38 |
| 1,095,049 | A | * | 4/1914 | Voller | 89/38 |

(Continued)

FOREIGN PATENT DOCUMENTS

| | | |
|---|---|---|
| DE | 277 306 | 8/1914 |
| DE | 977 774 | 1/1970 |

(Continued)

OTHER PUBLICATIONS

International Search Report for International Application No. PCT/IB2012/000908 mailed Oct. 22, 2012 (3 pages).

*Primary Examiner* — Joshua Freeman

(74) *Attorney, Agent, or Firm* — Merchant & Gould P.C.

(57) ABSTRACT

An assembly of a turret and low radar reflection weapon includes a turret (100) and a weapon (200) associated with the turret (100). The weapon (200) includes a first rest configuration, in which the weapon (200) is totally hidden inside the turret (100), and a second operating configuration, in which at least part of a barrel of said weapon projects from said turret (100). The turret (100) includes shielding, hatches and a false deck (110, 120, 111, 112; 121, 122) for hiding said weapon (200) with a low radar reflection shape.

10 Claims, 3 Drawing Sheets

(51) Int. Cl.
*F41H 5/16* (2006.01)
*F41H 5/20* (2006.01)

(56) References Cited

U.S. PATENT DOCUMENTS

| | | | | | |
|---|---|---|---|---|---|
| 1,188,702 | A * | 6/1916 | Ternstrom | 89/36.14 |
| 1,296,688 | A * | 3/1919 | Noah | 114/6 |
| 1,309,483 | A * | 7/1919 | Ludlow | 89/38 |
| 1,324,800 | A * | 12/1919 | Dawson | 89/38 |
| 2,491,608 | A * | 12/1949 | Duplessis | 89/41.12 |
| 4,141,277 | A * | 2/1979 | Bouillon | 89/38 |
| 7,854,189 | B1 * | 12/2010 | Fox | 89/1.804 |
| 8,065,948 | B1 * | 11/2011 | Baptista et al. | 89/36.14 |
| 8,069,800 | B2 * | 12/2011 | Philippe et al. | 114/15 |
| 8,146,479 | B2 * | 4/2012 | Cazalieres et al. | 89/36.13 |
| 2002/0186484 | A1 | 12/2002 | Casteleiro et al. | |
| 2008/0216727 | A1 * | 9/2008 | Philippe et al. | 114/15 |
| 2009/0120271 | A1 * | 5/2009 | Diller et al. | 89/33.14 |
| 2010/0071540 | A1 * | 3/2010 | Cazalieres et al. | 89/41.01 |
| 2011/0056367 | A1 * | 3/2011 | Cazalieres et al. | 89/36.13 |
| 2012/0180641 | A1 * | 7/2012 | Chiappini et al. | 89/36.13 |
| 2014/0150637 | A1 * | 6/2014 | Chiappini | 89/36.13 |
| 2014/0174283 | A1 * | 6/2014 | Kempas | 89/1.815 |
| 2014/0224104 | A1 * | 8/2014 | Kempas | 89/1.815 |

FOREIGN PATENT DOCUMENTS

| | | |
|---|---|---|
| EP | 1 992 901 | 11/2008 |
| EP | 2 071 268 | 6/2009 |
| FR | 2 726 898 | 5/1966 |

* cited by examiner

ASSEMBLY OF TURRET AND LOW RADAR REFLECTION WEAPON

This application is a National Stage Application of PCT/IB2012/000908, filed 8 May 2012, which claims benefit of Serial No. TO2011A000455, filed 25 May 2011 in Italy and which applications are incorporated herein by reference. To the extent appropriate, a claim of priority is made to each of the above disclosed applications.

BACKGROUND

The present invention is relative to a turret and to a firearm associated thereto and, in detail, it is relative to an assembly of turret and low radar reflection weapon.

It is known that one of the main distance identification techniques in the military field consists in identifying the source of a radar echo.

It is also a long time since it is know that military designers developed the stealth technology, which is linked to the reduction of the radar signature, i.e. the reflection of the incident radar wave; the stealth technology is connected, above all, to the particular shape that the objects designed for this purpose end up assuming, which made the study of this aspect of the technology very challenging. Together with the stealth technology, in terms of shapes, designers also tested radar-absorbent materials, the so-called RAMs, which can "capture" part of the energy (of a radio wave emitted by a radar) hitting them, in the same way in which a dark object "captures" the visible light of the sun, thus turning it into heat. In general, the above-mentioned materials are resins with particles of ferrite in suspension.

The radar signature of a body is typically identified by means of the so-called radar cross section a, which determines the power of the radio wave reflected by the target according to the following equation:

$$P_r = \frac{P_t G_t}{4\pi r^2} \sigma \frac{1}{4\pi r^2} A_{eff}$$

Wherein:

Pt is the power [w] transmitted by a radar transmitter;

Gt is the gain of the transmitting radar antenna;

r is the distance [m] along a straight line between the transmitting radar and the target;

σ is the radar cross section [$m^2$]

Aeff is the effective area [$m^2$] of the receiving radar antenna (typically coinciding with the transmitting antenna).

It is also known that cannons, as well as many other large-caliber weapons, such as howitzers, four-barreled firearms, heavy submachine guns, are mounted on rotatory turrets, which are able to rotate around a rotation axis, which is substantially vertical, so as to allow an azimuthal rotation of the firearm. The firearm, furthermore, can also rotate in a zenithal direction.

It is also known that the shape of the turret is usually inefficient in terms of radar signature, since, due to constructive constraints, it cannot assume shapes that allow it to significantly reduce its signature.

Furthermore, the cannon presents clear limits in terms of the shape that can be obtained and of the materials that can be used, since its resistance and shape are defined by the function that it has to fulfill and by the thermal and mechanical stresses to which it is subject during the shooting operations.

SUMMARY

The object of the present invention is to describe an assembly of turret and low radar reflection weapon, which does not present the drawbacks described above.

According to the present invention, an assembly of turret and low radar reflection firearm is provided.

BRIEF DESCRIPTION OF THE DRAWINGS

The invention will now be described with reference to the accompanying drawings, which illustrate a non-limiting embodiment, wherein.

DETAILED DESCRIPTION

Figure 1:
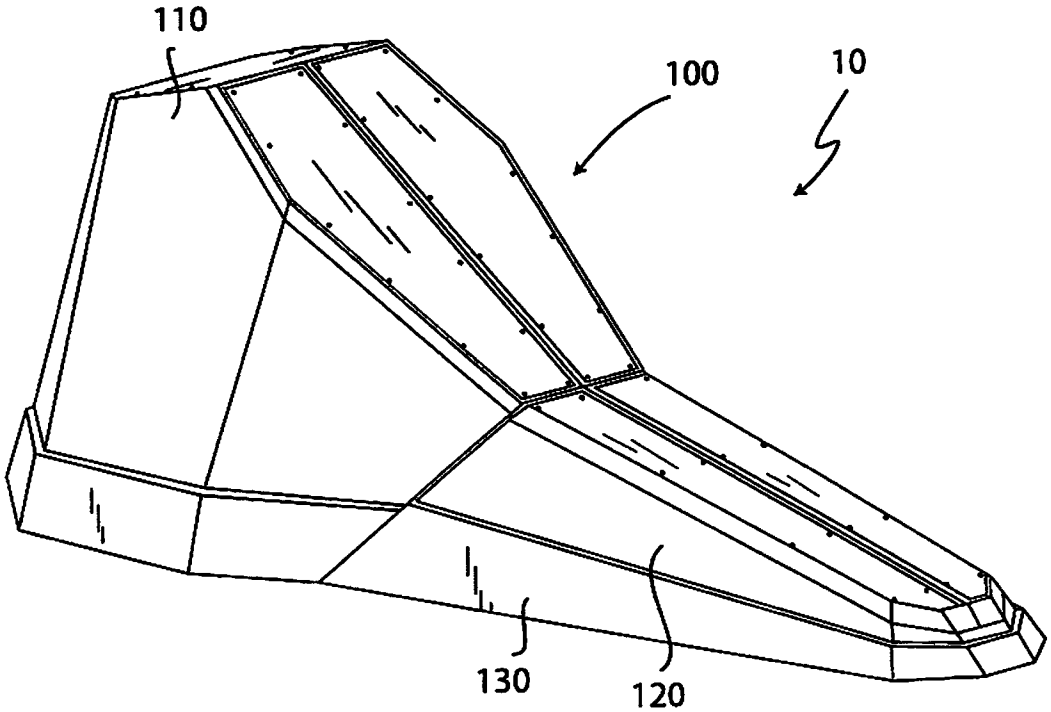
FIG. 1 shows a prospective view of an assembly of turret and weapon according to the present invention, in a closed configuration.
Figure 2:
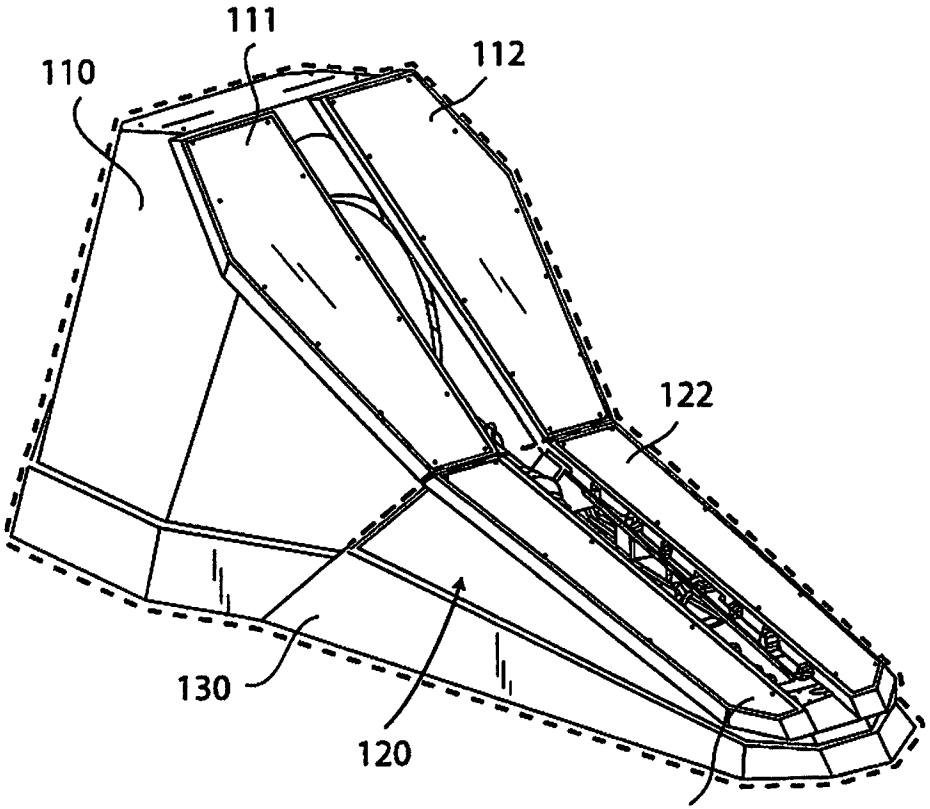
FIG. 2 shows a prospective view of the assembly of FIG. 1, when the turret is in a partially open position.
Figure 3:
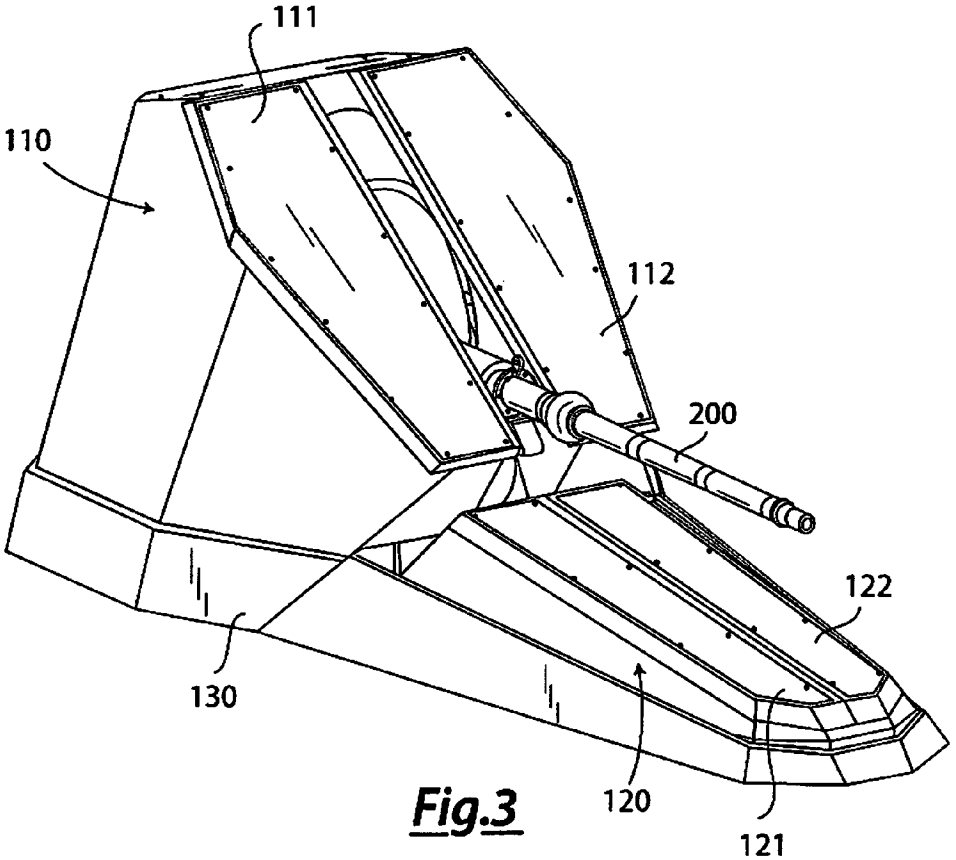
FIG. 3 shows a prospective view of the assembly of FIG. 1 in an operating configuration.

Number 10 indicates an assembly of turret and low radar reflection weapon as a whole.

The assembly is able to reduce, due to its geometry, the radar cross section [$m^2$] presented by an incident radio radar wave.

Assembly 10 comprises a turret 100 and a weapon 200, which is mounted on said turret and is able to rotate around a first azimuthal rotation axis, which, in use, is substantially vertical, and around a second zenithal rotation axis, which is substantially arranged horizontal.

Turret 100 comprises an upper shield 110, a mobile false deck 120, and a fixed false deck 130.

Upper shield 110 is the actual shield that encloses the firearm system, to which it is connected in an integral manner in a traverse; mobile false deck 120 and fixed false deck 130 are arranged, by way of non-limiting example, on the upper deck of a ship by means of an interface.

Upper shield 110 and mobile false deck 120 comprise a mobile covering system for covering the barrel of weapon 200 in a non-operating configuration.

Upper shield 110 comprises, indeed, a pair of sliding hatches 111, 112, which are arranged on a front part of the shield itself, namely in a portion of turret 100 from which the barrel of the weapon projects.

Sliding hatches 111, 112 can be arranged in an open position, in which they allow the barrel of weapon 200 to come out of the turret and, thus, to reach the above-mentioned operating configuration, and in a closed position, in which they allow the inside of turret 100 itself to be covered.

Sliding hatches 111, 112 are moved by means of a hydraulic actuating system.

Mobile false deck 120 is arranged above fixed false deck 130 and is adapted for hiding the barrel of weapon 200 in a non-operating condition or configuration. During the passage from the above-mentioned operating configuration to the above-mentioned non-operating configuration, hatches 111, 112 of upper shield 110 open up, in order to allow the barrel to come out, and mobile false deck 120 rotates around a hinge, which is arranged in the front part of turret 100; after the barrel has come out and, thus, after assembly 10 has reached its operating configuration (ready to shoot), mobile false deck 120 remains in a lowered position and the two hatches 111, 112 close again.

In this way, when weapon 200 is in a non-operating configuration, namely in a rest configuration, it is completely hidden inside turret 100.

The rotation of mobile false deck 120 allows both the traverse of weapon 200, thus its zenithal rotation, and the expulsion of the shell cases shot from a door which is arranged in a lower portion of the barrel of weapon 200; said portion overlooks, therefore, the upper deck.

Fixed false deck 130 is a contact means between mobile false deck 120 and the upper deck of the ship. Fixed false deck 130 is a necessary element that adapted for covering the area of a base, on which entire assembly 10 is mounted.

Hatches 111, 112 are made of a metal material (steel) and are provided with emergency springs, which, in case of a fault of the hydraulic opening system used to open the doors themselves, automatically open the doors.

The emergency springs are compression springs and, as already mentioned above, they are adapted to guarantee the opening of the hatches in case of a fault of one of the components of the hydraulic system used to open and close the hatches. In detail, the emergency springs are housed inside a sleeve, which is mounted on an insert made of metal material of upper shield 110. Each one of the emergency springs pushes against a stem, which, in turn, is in contact with the hatch, so as to guarantee its sliding; when the spring is completely compressed, the hatch is closed; when the spring is completely released, namely when it is minimally compressed, the hatch is open.

Assembly 10 is manufactured by taking into account the particular operating configurations for which it is designed.

By way of example, if assembly 10 is installed on an upper deck of a ship, all the components have to be shaped taking into account two types of load, a first load induced by the sea and a second load induced by the shooting.

The load induced by the sea, also known as green water load is the load to which assembly 10 is subject under rough sea conditions, said load being due, for example, to a wavefront that, under critical conditions, is assessed to be equal to 0.7 bar in pressure. This means that assembly 10 is manufactured in such a way that prevents it from collapsing or suffering permanent damages.

The load induced by the shooting, instead, is a heavy load, to which assembly 10 and, in particular, upper shield 110 is subject; as a matter of fact, the latter is the part of assembly 10 that, in correspondence to traverse angles close to zero, is subject to a pressure wave induced by the shooting. In particular, the pressure wave induced by the shooting that affects turret 100 is the part that comes out of the muzzle brake.

Hatches 111, 112, furthermore, are provided with a respective covering, which is made of a composite material and can be easily disassembled, so as to make the door accessible for possible maintenance activities; when they are closed, hatches 111, 112 are respectively separated by an elastic element (e.g. made of rubber), which is useful to avoid the direct contact of a door with the other one.

Hatches 111, 112 open by means of a sliding (or axial sliding movement) along a space that is sufficient to allow the barrel and the cradle of weapon 200 to come out; possible recoil brakes do not interfere with the doors 111, 112 during the elevation of the barrel and, therefore, no special housings need to be created.

Mobile false deck 120 comprises a pair of hatches 121, 122, which can be opened and closed in an axially sliding manner; said doors 121, 122 present a smaller inclination with respect to the fixed false deck compared to hatches 111, 112 of upper shield 110.

Hatches 121, 122 of mobile false deck 120 are necessary to allow the complete retraction of weapon 200 in a non-operating configuration; typically, in this case, the barrel of the weapon is positioned with a negative inclination with respect to the plane of fixed false deck 130, namely it is oriented in a direction that points downwards.

Mobile false deck 120 presents a front part 120*a* and a rear part 120*b;* rear part 120*b* is the closest to upper shield 110; front part 120*a* is opposite to rear part 120*b* and, therefore, is arranged at a greater distance from upper shield 110.

In correspondence to front part 120*a*,mobile false deck 120 comprises a hinge, which is configured to allow its rotation around a mobile deck rotation axis, which is arranged parallel to a plane on which fixed false deck 130 lies. In this way, the front part of mobile false deck 120 remains substantially still, while rear part 120*b* of mobile false deck 120 can rotate and, consequently, be lowered or lifted with respect to the upper deck on which assembly 10 is installed.

Therefore, during the passage from a rest configuration to an operating configuration of weapon 200:

- hatches 111, 112 and 121, 122 of upper shield 110 and of the mobile false deck open up;
- the weapon is lifted with respect to the rest configuration;
- hatches 121, 122 of mobile false deck 120 close up;
- mobile false deck 120 is rotated, so as to lower the position of its rear part 120*b* with respect to the front part.

The movements of the hatches, of the mobile false deck and of the upper shield take place by means of a data processing unit, which controls in an automatic manner an actuating stage, which is preferably hydraulic and supplied with electrical energy.

The data processing unit presents, furthermore, a manual control for the movements of the hatches, of the mobile false deck and of the upper shield, which is useful when, under emergency conditions, the automatic actuation is not possible.

The hydraulic actuator of the opening and closing of the hatches, of the mobile false deck and of the upper shield is independent of the hydraulic actuator of weapon 200.

Furthermore, hatches 121, 122 of the false mobile deck are also configured so as to be able to open under emergency conditions by means of a spring, exactly in the same way as hatches 111, 112 of the upper shield.

The advantages of the assembly according to the present invention are known in the light of the present description. In particular, it allows a reduction of the RADAR signature, which is typically present when the assembly of weapon and turret is not in an operating condition, namely ready to shoot; this is possible thanks to a combined action provided:

a) by the shape of the turret, which is configured to present a shape of the surfaces, lines or angles that are such as to reduce the radar signature; and b) by the hiding of weapon 200 itself, which, since it is enclosed by the turret itself when it is not used, allows in any case a reduction of the surface (or effective area) that is likely to be the target of a beam of radio waves coming from a radar and, therefore, allows the intensity of the radar echo reflected to be proportionally reduced.

To the two features mentioned above one should add the fact that, if the assembly according to the present invention, or even turret 100 alone, is produced or shielded with materials with a low radar reflectivity, the mitigation effect of the radar echo reflected would be even greater.

Obviously, the assembly described above can be subject to variations, additions and changes that are obvious to a skilled person, without in this way going beyond the scope of protection provided by the accompanying claims.

The invention claimed is:

1. An assembly of turret and low radar reflection weapon, the assembly comprising: a turret and a weapon associated thereto;

said weapon comprising a barrel, wherein in a first rest configuration, said barrel is totally hidden inside the turret, and a second operating configuration, in which at least part of said barrel of said weapon projects from said turret;

said turret includes a hiding device for hiding said weapon and a fixed false deck; said hiding device comprising a low radar reflection shape;

wherein the turret is configured to present a shape of a surface, lines and angles that reduce a radar signature;

wherein said hiding device comprises a mobile false deck and an upper shield of said turret, wherein said upper shield comprises a plurality of hatches having an open configuration for allowing said weapon to come out and a closed configuration for hiding said weapon.

2. Assembly according to claim 1, wherein said mobile false deck comprises a plurality of hatches.

3. Assembly according to claim 1, wherein a plurality of doors of said mobile deck are configured to open during passage of the weapon from said rest configuration to said operating configuration and to dose again when said weapon is in said operating configuration.

4. Assembly according to claim 1, wherein said hatches are axially sliding.

5. Assembly according to claim 1, further comprising a fixed false deck; said fixed false deck being contact means between said mobile false deck and the deck of a boat or ship.

6. Assembly according to claim 5, wherein said deck of said boat or ship comprises a base, and wherein said fixed false deck covers said base.

7. Assembly according to claim 2, wherein said hatches are opened and closed by a hydraulic system and comprise emergency opening means, which are distinct from said hydraulic system.

8. Assembly according to claim 7, wherein said emergency opening means comprise a compression spring.

9. Assembly according to claim 1, wherein said hatches are covered with a covering layer made of composite material.

10. An assembly of turret and low radar reflection weapon, the assembly comprising: a turret and a weapon associated thereto;

said weapon comprising a barrel, wherein in a first rest configuration, said barrel is totally hidden inside the turret, and a second operating configuration, in which at least part of said barrel of said weapon projects from said turret;

said turret comprising means for hiding said weapon and a fixed false deck; said means for hiding said weapon comprising a low radar reflection shape;

wherein the turret is configured to present a shape of a surface, lines and angles that reduce a radar signature;

wherein said means for hiding said weapon comprise a mobile false deck and an upper shield of said turret, wherein said upper shield comprises a plurality of hatches having an open configuration for allowing said weapon to come out and a closed configuration for hiding said weapon.

* * * * *